US008746921B1

(12) United States Patent
Bigge

(10) Patent No.: US 8,746,921 B1
(45) Date of Patent: Jun. 10, 2014

(54) ADJUSTABLE MULTI-DISTRIBUTIVE LIGHTING MOUNT

(75) Inventor: William Joseph Bigge, Newnan, GA (US)

(73) Assignee: Cooper Technologies Company, Houston, TX (US)

( * ) Notice: Subject to any disclaimer, the term of this patent is extended or adjusted under 35 U.S.C. 154(b) by 109 days.

(21) Appl. No.: 13/449,794

(22) Filed: Apr. 18, 2012

(51) Int. Cl.
*G09F 13/04* (2006.01)

(52) U.S. Cl.
USPC ..... 362/225; 362/427; 362/249.01

(58) Field of Classification Search
USPC ..... 362/225, 249.1, 427, 117, 148, 145, 362/150
See application file for complete search history.

(56) References Cited

U.S. PATENT DOCUMENTS 5,951,139 A * 9/1999 Smith et al. ..... 362/33
2008/0212329 A1* 9/2008 Duguay et al. ..... 362/310
2012/0033412 A1* 2/2012 Molina et al. ..... 362/119

* cited by examiner

*Primary Examiner* — Evan Dzierzynski
(74) *Attorney, Agent, or Firm* — King & Spalding LLP

(57) ABSTRACT

A multi-distributive lighting mount includes a first mounting surface rotatably coupled to a second mounting surface. Longitudinally extending LED light modules are coupled to each of the first and second mounting surfaces. The direction of light for each of the first LED light module and the second LED light module is affected by the rotational positioning of the first mounting surface with respect to the second mounting surface. The first mounting surface can also include a first barrel portion and a second barrel portion. The second mounting surface can also include a first barrel portion and a second barrel portion. A pin extends through the second barrel portion of the first mounting surface and the second barrel portion of the second mounting surface to rotatably couple the first mounting surface to the second mounting surface and to act as the axis of rotation of the first mounting surface with respect to the second mounting surface.

13 Claims, 6 Drawing Sheets

ADJUSTABLE MULTI-DISTRIBUTIVE LIGHTING MOUNT

TECHNICAL FIELD

The present disclosure generally relates to a multi-distributive lighting mount and, more particularly, to a multi-distributive lighting mount including first and second mounting surfaces that pivot at a pivot point to allow for adjustment of the light distributed from a light source.

BACKGROUND

It is common for light fixtures to include one or more light sources maintained at a fixed position. That is, commonly, a light source within a light fixture is maintained and held at a single position and is unable to be adjusted to a different position, for a variation in the distribution of light from the source. Thus, light distributed from a light fixture with a fixed lighting source will always provide the same light distribution over an area where the light fixture is installed. For example, if the light fixture is installed in a ceiling, the light generated by the light source within the light fixture will always distribute light in the same manner across a room where the light fixture is installed. In many applications, it would be desirable to change the direction or distribution of the light emitted by the light source to provide a provide a broader range of light distributions in a single light fixture. For example, it may be desirable to distribute light from a light source across a larger area when it is relied upon by several people, and focus the light from the light sources on a single area when it is relied upon by a single person. Additionally, it may be desirable to distribute light in various angles depending upon the time of day. Also, because the dimensions of rooms generally differ in many homes, offices, and retail areas, a light fixture that provides the ability to modify the distribution of light from the fixture would advantageously offer flexibility for the installation of the light fixture in rooms of various dimensions or having various or changes uses.

For some light fixtures, if a light source of the fixture cannot be moved, the light source may be repositioned by repositioning the light fixture itself. Some light fixtures, such as lamps, may be moved to different locations depending upon a desired distribution of light. However, certain light fixtures, such as wall- and ceiling-mounted light fixtures, cannot be easily moved or repositioned to change a distribution of light provided by the fixtures.

SUMMARY

In one exemplary embodiment, an adjustable lighting mount can include a first mounting surface. The first mounting surface can have a first longitudinal side and an opposing second longitudinal side. A first light source can be coupled to the first mounting surface. The adjustable lighting mount can also include a second mounting surface rotatably coupled to the first mounting surface along the second longitudinal side of the first mounting surface. A second light source can be coupled to the second mounting surface. The adjustable light mount can further include a means for rotating the first mounting surface with respect to the second mounting surface. The means for rotating can be coupled to the second longitudinal side of the first mounting surface.

In another exemplary embodiment, the means for rotating can include a cam having a spiraling channel. The cam can include first and second spiraling channels, and the means for rotating can further include a second cam having first and second spiraling channels. The means for rotating can further include a first pin extending through the first channel of the first cam, through the first barrel portion of the first mounting surface, and through the first channel of the second cam. The means for rotating can further include a second pin extending through the second channel of the first cam, through a first barrel portion of the second mounting surface, and through the second channel of the second cam.

In another exemplary embodiment, the means for rotating can include a scissor-action mechanism. The means for rotating can include a first scissor arm including a barrel at a first end of the arm, a pin eye at a second end of the arm, and a channel between the first and second ends of the arm. The means for rotating can further include a second scissor arm including a barrel at a first end of the arm, a pin eye at a second end of the arm, and a channel between the first and second ends of the arm. The means for rotating can also include an adjustment branch including an adjustment tab, an attachment opening, and a pair of adjustment pegs, where the pair of adjustment pegs are slideably positioned within the channels of the first and second scissor arms.

These and other aspects, objects, features, and embodiments will become apparent to a person of ordinary skill in the art upon consideration of the following detailed description of illustrative embodiments exemplifying the best mode as presently perceived.

BRIEF DESCRIPTION OF THE DRAWINGS

For a more complete understanding of the exemplary embodiments and the advantages thereof, reference is now made to the following description, in conjunction with the accompanying figures briefly described as follows.

Figure 1:
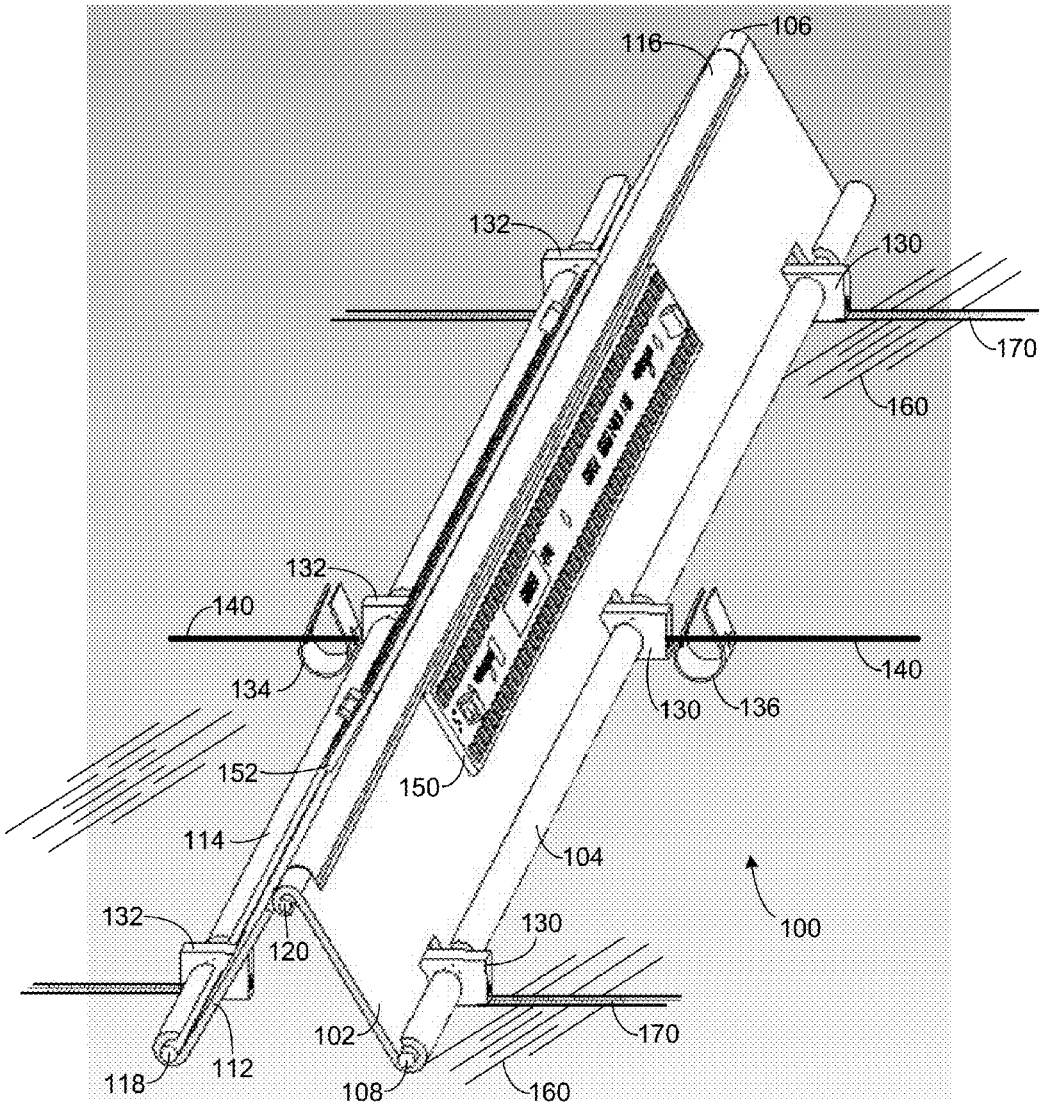
FIG. 1 provides a perspective view of a multi-distributive lighting mount in accordance with one exemplary embodiment.

The drawings illustrate only exemplary embodiments and are therefore not to be considered limiting of its scope, as other equally effective embodiments are within the scope and spirit of this disclosure. The elements and features shown in the drawings are not necessarily drawn to scale, emphasis instead being placed upon clearly illustrating the principles of the exemplary embodiments. Additionally, certain dimensions or positionings may be exaggerated to help visually convey such principles. In the drawings, reference numerals designate like or corresponding, but not necessarily identical, elements.

DETAILED DESCRIPTION

In the following paragraphs, the exemplary embodiments are described in further detail by way of example with reference to the attached drawings. In the description, well-known components, methods, and/or processing techniques are omitted or briefly described so as not to obscure the embodiments. As used herein, the "present invention" refers to any one of the embodiments of the invention described herein and any equivalents. Furthermore, reference to various feature(s) of the "present invention" is not to suggest that all embodiments must include the referenced feature(s).

Turning now to the drawings, in which like numerals indicate like elements throughout, exemplary embodiments of the invention are described in detail. FIG. 1 provides a perspective view of an exemplary embodiment of an adjustable multi-distributive lighting mount 100. The exemplary multi-distributive lighting mount 100 includes a first light source mounting surface or wing 102 having a first barrel portion 104 adjoined at a first longitudinal side or edge and a second barrel portion 106 adjoined at a second longitudinal side or edge, and a second light source mounting surface or wing 112 having a first barrel portion 114 adjoined at a first longitudinal side or edge and a second barrel portion 116 adjoined at a second longitudinal side or edge. In certain exemplary embodiments, each barrel portion 104, 114, 106, and 116 includes a cylindrically-shaped hollow portion along an edge of one of the mounting surfaces or wings 102, 112. In various embodiments, the cylindrical shape of each barrel portion 104, 114, 106, and 116 does not necessarily create a completely closed cylinder. In other words, each barrel portion 104, 114, 106, and 116 may include an arcuate extension along an edge of one of the mounting surfaces or wings 102, 112, without forming a complete cylinder.

In certain exemplary embodiments, each of the first wing 102 and the second wing 112 has a substantially planar top surface for receiving a respective lighting device 150, 152. The first wing 102 and the second wing 112 are adjoined by a means for rotationally coupling the first wing 102 and the second wing 112, such as a pin 120 extending through the second barrel portion 106 of the first wing 102 and through the second barrel portion 116 of the second wing 112. In other words, the first and second wings 102 and 112 are rotatably coupled along the second longitudinal sides or edges of the first and second wings 102 and 112. The pin 120 adjoins the first and second wings 102 and 112 at a pivot point such that the first and second wings 102 and 112 are free to pivot about the pivot point, as described in further detail below.

In various exemplary embodiments, a lighting device 150 is mounted to the first wing 102, and a second lighting device 152 is mounted to the second wing 112. The lighting devices 150 and 152 may be mounted to the first and second wings 102 and 112 using any mechanical means suitable for the application such as screws, rivets, clips, or magnets or using adhesives, for example. Each of the lighting devices 150 and 152 may include, for example, a multitude of LEDs and other circuitry associated with the LEDs. For example, the lighting devices 150 and 152 may include circuit traces, capacitors, and resistors, among other elements, to support the function of the LEDs on the lighting devices 150 and 152.

Examples of lighting devices 150 and 152 include the linear LED light modules described in co-pending U.S. patent application Ser. Nos. 13/095,349; 13/095,394; and 12/617,127, the entire contents of each of which are hereby incorporated herein by reference for all purposes. For example, each lighting device 150, 152 is configured to create artificial light or illumination via multiple LED's. Each LED may be a single LED die or may be an LED package having one or more LED dies on the package. In certain exemplary embodiments, the number of dies on each LED package ranges from 1-312. For example, each LED package may include 2 dies.

In certain exemplary embodiments, each lighting device 150, 152 includes at least one substrate to which the LED's are electrically and/or mechanically coupled. Each substrate includes one or more sheets of ceramic, metal, laminate, circuit board, flame retardant (FR) board, mylar, or another material. Each exemplary lighting device 150, 152 has a substantially rectangular shape. However, a person of ordinary skill in the art having the benefit of the present disclosure will recognize that the substrate can have any linear or non-linear shape. Each LED is attached to its respective substrate by a solder joint, a plug, an epoxy or bonding line, or other suitable provision for mounting an electrical/optical device on a surface. Each LED includes semi-conductive material that is treated to create a positive-negative (p-n) junction. When the LED's are electrically coupled to a power source (not shown), such as an LED driver, current flows from the positive side to the negative side of each junction, causing charge carriers to release energy in the form of incoherent light. Although not illustrated, the LEDs on the lighting devices 150, 152 are powered by a suitable power supply and/or LED driver so that the LEDs illuminate and operate as a light source.

In alternative embodiments and depending upon the scale (i.e., size) of the lighting mount 100, the lighting devices 150 and 152 may include light sources other than LEDs, such as organic light emitting diodes (OLEDs), incandescent or miniature incandescent bulbs, compact florescent lights (CFLs), or other known light sources. It is noted that the LEDs mounted on the lighting devices 150 and 152 primarily distribute light in one direction away from a plane of the substrate that the LEDs are disposed on. The multi-distributive lighting mount 100 is capable of repositioning the distribution of light from the LEDs on the lighting devices 150 and 152 over a relatively large range. Particularly, based upon the pivot provided by the pin 120, the lighting devices 150 and 152 may be repositioned to distribute light from the LEDs in various directions as described in further detail below.

The multi-distributive lighting mount 100 further includes at least one first base 130 slidably positioned over a substrate 160 and at least one second base 132 slidably positioned over the substrate 160. Together, a base 130 and a base 132 may be described herein as a "pair" of first and second bases 130 and 132. As described in further detail below, in certain exemplary embodiments, the multi-distributive lighting mount 100 includes multiple pairs of the first and second bases 130 and 132. In certain exemplary embodiments, each pair of first and the second bases 130 and 132 is slidably positioned within a channel 170 of the substrate 160, permitting the first and second bases 130 and 132 to slide along a respective channel 170. As noted below, in certain exemplary embodiments, a channel 170 is formed within the substrate 160 for each pair of the first and second bases 130 and 132. It is noted that, in certain aspects, the pair of first and second bases 130 and 132 comprise, at least in part, means for rotating the first and second wings 102 and 112.

A first pin 108 of the multi-distributive lighting mount 100 extends through the first barrel portion 104 of the first wing 102, through the first base 130 in a first direction, and adjoins the first barrel portion 104 of the first wing 102 and the first base 130. The first pin 108 extends through both the first barrel portion 104 and the first base 130 and maintains a physical attachment between the first base 130 and the first wing 102, while permitting the first base 130 at least one degree of freedom to move with respect to the first wing 102. The first pin 108 extends through the first base 130 in a first direction through a hole (not illustrated) extending through the first base 130 in the first direction.

A second pin 118 of the multi-distributive lighting mount 100 extends through the first barrel portion 114 of the second wing 112, through the second base 132 in a first direction, and adjoins the first barrel portion 114 of the second wing 112 and the second base 132. The second pin 118 extends through both the first barrel portion 114 and the second base 132 and maintains a physical attachment between the second base 132 and the second wing 112, while permitting the second base 132 at least one degree of freedom to move with respect to the second wing 112. The second pin 118 extends through the second base 132 in a first direction through a hole (not illustrated) extending through the second base 132 in the first direction. It is noted that, according to the arrangement of the elements of the multi-distributive lighting mount 100 illustrated in FIG. 1, the first direction which the second pin 118 extends through the second base 132 is the same as the first direction which the first pin 108 extends through the first base 130. It is noted that, in certain aspects, the means for rotating the first and second wings 102 and 112 further includes the first and second pins 108 and 118.

In various exemplary embodiments, the substrate 160 includes any generally flat surface upon which the multi-distributive lighting mount 100 may be mounted. Additionally, in exemplary embodiments, the substrate 160 is composed of a material suitable for forming the channel 170 therein. In certain exemplary embodiments, the channel 170 and/or the first and second bases 130 and 132 include indentations, grooves, or secondary channels for aligning and securing the first and second bases 130 and 132 within the channel 170, while still permitting the first and second bases 130 and 132 to slide along and within the channel 170.

The first and second bases 130 and 132 may rotate or pivot about the pins 108 and 118, respectively, while being permitted to slide within the channel 170. As the first and second bases 130 and 132 slide within the channel 170, the first and second wings 102 and 112 pivot about the pivot point created by the pin 120, as described in further detail below with reference to FIGS. 2A and 2B. It is also noted that, as illustrated in FIG. 1, the exemplary multi-distributive lighting mount 100 includes multiple first bases 130 and second bases 132. In one exemplary embodiment, the multi-distributive lighting mount 100 also includes a respective channel 170 for each first and second base pair 130 and 132. Although three first and second base pairs 130 and 132 are illustrated in FIG. 1 at respective spaced-apart positions, other numbers of first and second base pairs 130 and 132 are within the scope and spirit of this disclosure. Additionally, the respective positions of the first and second base pairs 130 and 132 and the channels 170 may vary from that illustrated in FIG. 1, among embodiments.

The multi-distributive lighting mount 100 further includes at least one positioning rod 140 extending through one or more pairs of the first and second bases 130 and 132 in a second direction perpendicular to the first direction. As illustrated, the positioning rod 140 extends through a hole in each of the first and second bases 130 and 132 and extends completely through the first and second bases 130 and 132 in a second direction. In certain exemplary embodiments, the second direction is perpendicular to the first direction which the pins 108 and 118 pass through the first and second bases 130 and 132. As such, each of the first and second bases 130 and 132 includes a first hole extending through the base in a first direction and a second hole extending through the base in a second direction perpendicular to the first direction.

In certain exemplary embodiments, the multi-distributive lighting mount 100 includes multiple positioning rods 140, each for a respective pair of the first and second bases 130 and 132. In FIG. 1, only a single positioning rod 140 is illustrated, although multiple positioning rods 140 may exist, each for a respective pair of the first and second bases 130 and 132. Further, in certain exemplary embodiments, the channel 170 includes multiple channels 170, each for a pair of the first and second bases 130 and 132. In FIG. 1, two channels 170 are illustrated, although more than two channels 170 may exist. In one exemplary embodiment, a channel 170 is formed within the substrate 160 for each pair of first and second bases 130 and 132.

The exemplary multi-distributive lighting mount 100 further includes first and second friction clamps 134 and 136. The first friction clamp 134 adjustably maintains a first position on the positioning rod 140, and the second friction clamp 136 adjustably maintains a second position on the positioning rod 140. The positioning rod 140 passes through each of the first and second friction clamps 134 and 136. In one exemplary embodiment, the friction clamps 134 and 136 are formed, stamped, or bent in a shape that grips the positioning rod 140 and, when squeezed, releases the positioning rod 140. In an exemplary embodiment, the first and second friction clamps 134 and 136 are formed from a flexible metal or memory-shape alloy that seeks to maintain a particularly formed shape and offers resistance to forces that attempt to bend the material into shapes other than the particularly formed shaped. As illustrated in FIG. 1, the first and second friction clamps 134 and 136 "sandwich" the first and second bases 130 and 132 at a certain position along the positioning rod 140 which, in turn, maintains an angle between the first and second wings 102 and 112. When gripping the positioning rod 140 at the position illustrated in FIG. 1, the friction clamps 134 and 136 do not slide along the positioning rod 140. Thus, the friction clamps 134 and 136 prevent the first and second bases 130 and 132 from sliding. When adjusted to a different (wider) position along the positioning rod 140, the first and second bases 130 and 132 are able to slide along the channel 170, changing an angle between the first and second wings 102 and 112 and redistributing light generated by the lighting devices 152 and 152.

Figure 2A:
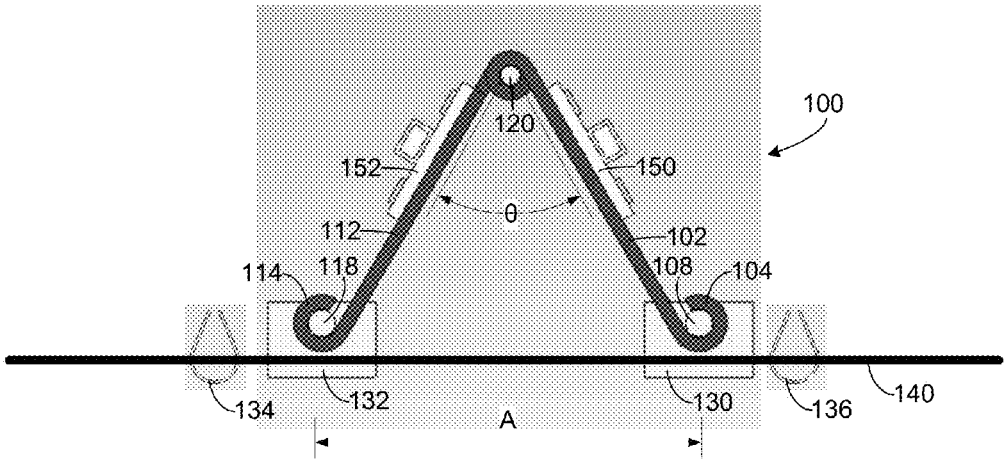
FIG. 2A provides a side view of the multi-distributive lighting mount of FIG. 1 in a first position in accordance with one exemplary embodiment.
Figure 2B:
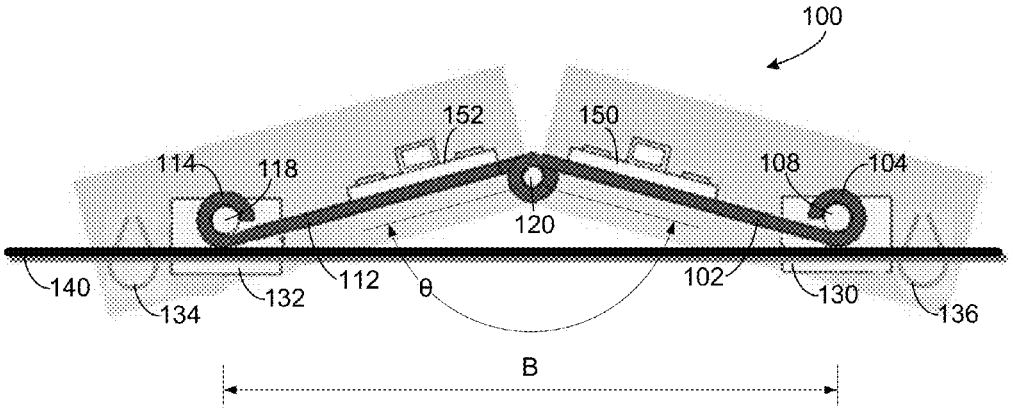
FIG. 2B provides a side view of the multi-distributive lighting mount of FIG. 1 in a second position in accordance with one exemplary embodiment.

Turning to FIGS. 2A and 2B, side views of the multi-distributive lighting mount 100 of FIG. 1 are described in detail. In FIG. 2A, the multi-distributive lighting mount 100 is maintained at a first position and, in FIG. 2B, the multi-distributive lighting mount 100 is maintained at a second position different than the first position. As illustrated, an angle θ exists between the first and second wings 102 and 112. Comparing FIG. 2A with FIG. 2B, it can be seen that the angle θ may vary across a range of angles based on the pivot created by the pin 120. Although FIGS. 2A and 2B illustrate the multi-distributive lighting mount 100 in two different positions, it should be appreciated that the mount 100 may be positioned over a range of the angle θ, including angles smaller than the angle θ illustrated in FIG. 2A and angles greater than the angle θ illustrated in FIG. 2B. In one exemplary embodiment, the angle θ may range from approximately 0 to 180 degrees.

Referring to FIG. 2A, it is noted that a first distance A exists between the centers of the first and second bases 130 and 132. In FIG. 2B, it is noted that a second distance B exists between the centers of the first and second bases 130 and 132. In FIG. 2A, light generated by the lighting devices 150 and 152 is distributed in a first direction. In FIG. 2B, because a different angle θ exists between the first and second wings 102 and 112, the light generated by the light devices 150 and 152 is distributed in a second direction different than the first direction.

It is noted that the respective positions of the first and second wings 102 and 112 illustrated in FIGS. 2A and 2B are dependent upon the respective positions of the first and second friction clamps 134 and 136 on the positioning rod 140. As illustrated in FIG. 2A, the first and second friction clamps 134 and 136 are positioned at respective first positions on the positioning rod 140 and, as illustrated in FIG. 2B, the first and second friction clamps 134 and 136 are positioned at respective second positions on the positioning rod 140. The respective second positions of the friction clamps 134 and 136 illustrated in FIG. 2B permit a larger angle θ to exist between the first and second wings 102 and 112, providing a different distribution of light as compared to the distribution provided in FIG. 2A.

It is again noted that the positions of the multi-distributive lighting mount 100 illustrated in FIGS. 2A and 2B are provided as examples only and other positions may be determined by a user of the multi-distributive lighting mount 100, to provide various distributions of light. In other words, as the first and second friction clamps 134 and 136 are repositioned over a range of positions on the positioning rod 140, a variation in the angle θ between the first and second wings 102 and 112 results in a varied distribution of light provided by the lighting devices 150 and 152. Thus, the multi-distributive lighting mount 100 provides advantages as compared to conventional light fixtures which fail to permit light sources to be repositioned and fail to permit light provided by the light sources to be redistributed. Particularly for a light fixture incorporating LED light sources, the range of light distribution provided by the multi-distributive lighting mount 100 offers additional flexibility in lighting options. In the exemplary embodiments described with reference to the remaining figures, an adjustment of a similar angle θ between wings is similarly attributable for a variation in a distribution of light achievable over a range of distribution.

Among the exemplary embodiments, the elements of the multi-distributive lighting mount 100, such as the first and second wings 102 and 112, the pins 108, 118, and 120, the bases 130 and 132, and the positioning rod 140, among other elements, may be manufactured from various types of materials suitable for the application such as aluminum, other various metals or metallic alloys, and various types of plastic, for example. It is noted, however, the multi-distributive lighting mount 100 may be formed from any material suitable for the application, without limitation.

Figure 3:
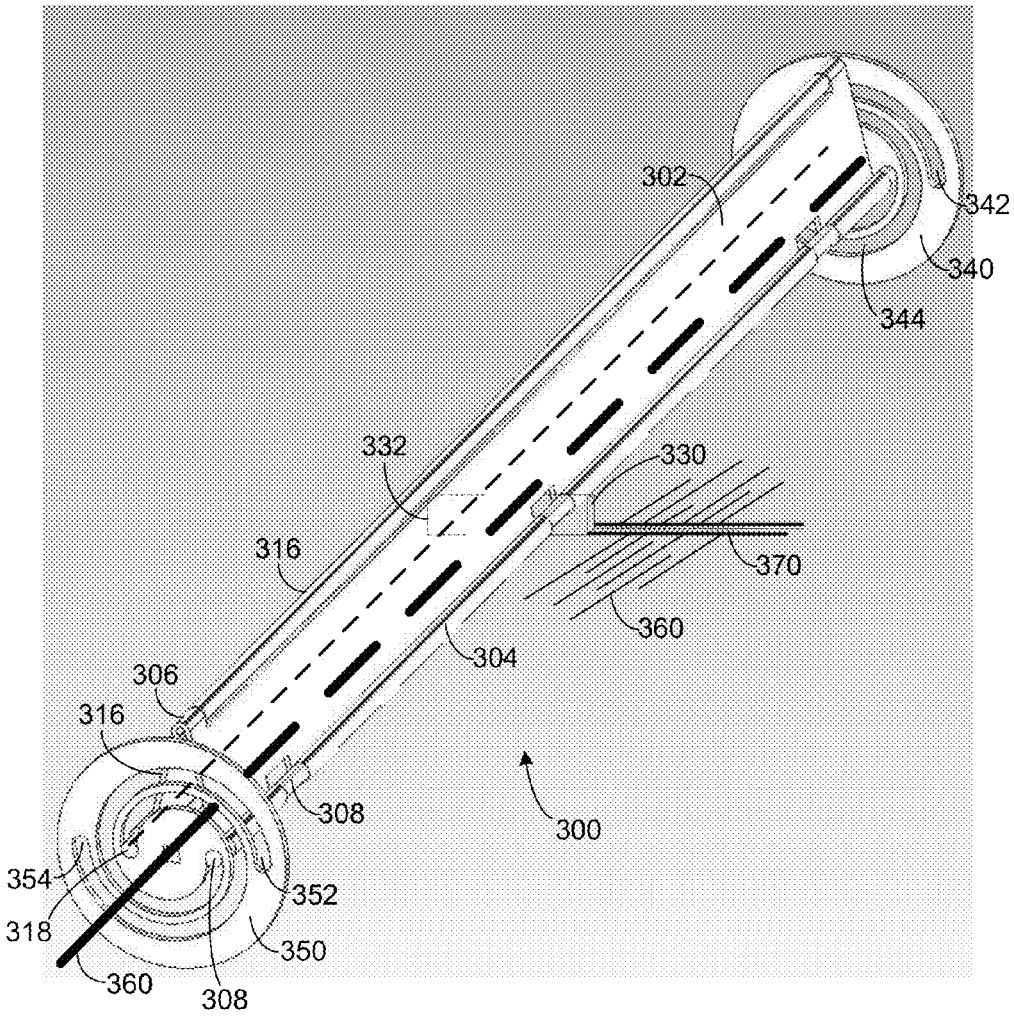
FIG. 3 provides a perspective view of another embodiment of a multi-distributive lighting mount in accordance with an alternative exemplary embodiment.

FIG. 3 provides a perspective view of an exemplary embodiment of an adjustable multi-distributive lighting mount 300. In FIG. 3, the multi-distributive lighting mount 300 includes a first light source mounting surface or wing 302 having a first barrel portion 304 adjoined at a first longitudinal side or edge and a second barrel portion 306 adjoined at a second longitudinal side or edge, and a second light source mounting surface or wing 312 having a first barrel portion 314 adjoined at a first longitudinal side or edge and a second barrel portion 316 adjoined at a second longitudinal side or edge. The first wing 302 and the second wing 312 are adjoined by a means for rotationally coupling the first wing 302 and the second wing 312, such as a pin 320 extending through the second barrel portion 306 of the first wing 302 and through the second barrel portion 316 of the second wing 312.

As illustrated in FIG. 3, the multi-distributive lighting mount 300 further includes a first cam 340 having first and second spiraling channels 342 and 344, and a second cam 350 having first and second spiraling channels 352 and 354. In one exemplary embodiment, the multi-distributive lighting mount 300 also includes a first base 330 slidably positioned over a substrate 360, and a second base 332 (hidden) slidably positioned over the substrate 360. Together, the base 130 and the base 132 may be described herein as a "pair" of first and second bases 330 and 332. In certain exemplary embodiments, the first and second bases 330 and 332 are slidably positioned within the channel 370 formed in the substrate 360. It is noted that, in certain aspects, the cams 340 and 350 and the pair of first and second bases 130 and 132 comprise, at least in part, means for rotating the first and second wings 302 and 312.

The multi-distributive lighting mount 300 also includes a first pin 308 extending through the first channel 342 of the first cam 340, through the first barrel portion 304 of the first wing 302, through the first base 330, and through the first channel 352 of the second cam 350. Also, the multi-distributive lighting mount 300 includes a second pin 318 extending through the second channel 344 of the first cam 340, through the first barrel portion 314 of the second wing 312, through the second base 332, and through the second channel 354 of the second cam 350.

In certain exemplary embodiments, the first pin 308 extends through both the first barrel portion 304 of the first wing 302 and the first base 330 and maintains a physical attachment between the first base 330 and the first wing 302, while permitting the first base 330 at least one degree of freedom to move with respect to the first wing 302. The first pin 308 extends through the first base 330 in a first direction through a hole (not illustrated) extending through the first base 330 in the first direction. In certain exemplary embodiments, the second pin 318 extends through both the first barrel portion 314 of the first wing 312 and the second base 332 and maintains a physical attachment between the first base 332 and the first wing 312, while permitting the second base 332 at least one degree of freedom to move with respect to the second wing 312. The second pin 318 extends through the second base 332 in a first direction through a hole (not illustrated) extending through the second base 332 in the first direction. It is noted that, according to the arrangement of the elements of the multi-distributive lighting mount 300 illustrated in FIG. 3, the first direction which the second pin 318 extends through the second base 332 is the same first direction which the first pin 308 extends through the first base 330. It is further noted that, in certain aspects, the means for rotating the first and second wings 302 and 312 further includes the pins 308 and 318.

Figure 4A:
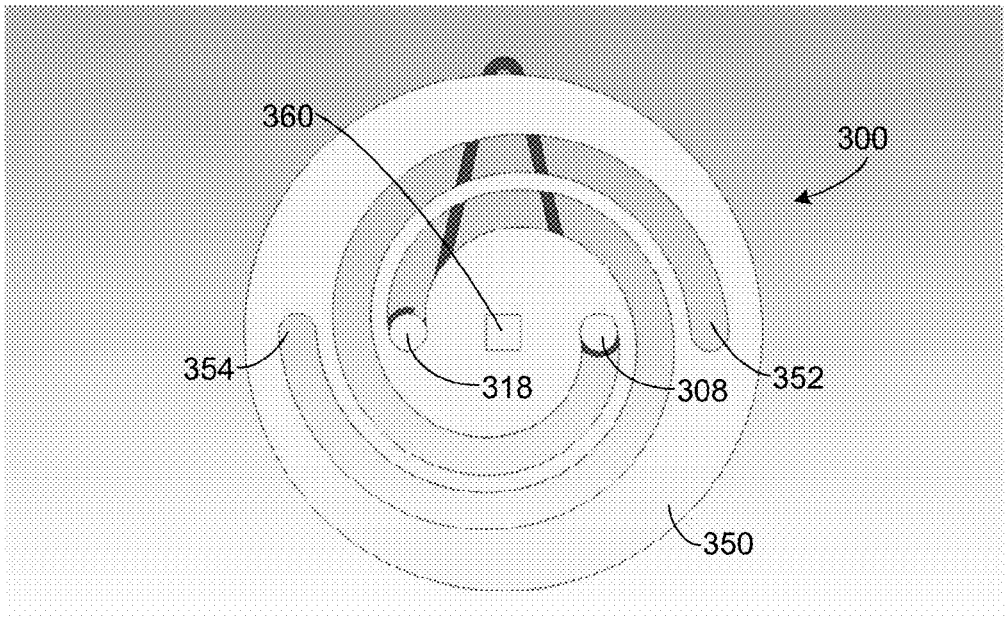
FIG. 4A provides a first side view of the multi-distributive lighting mount of FIG. 3 in accordance with one exemplary embodiment.
Figure 4B:
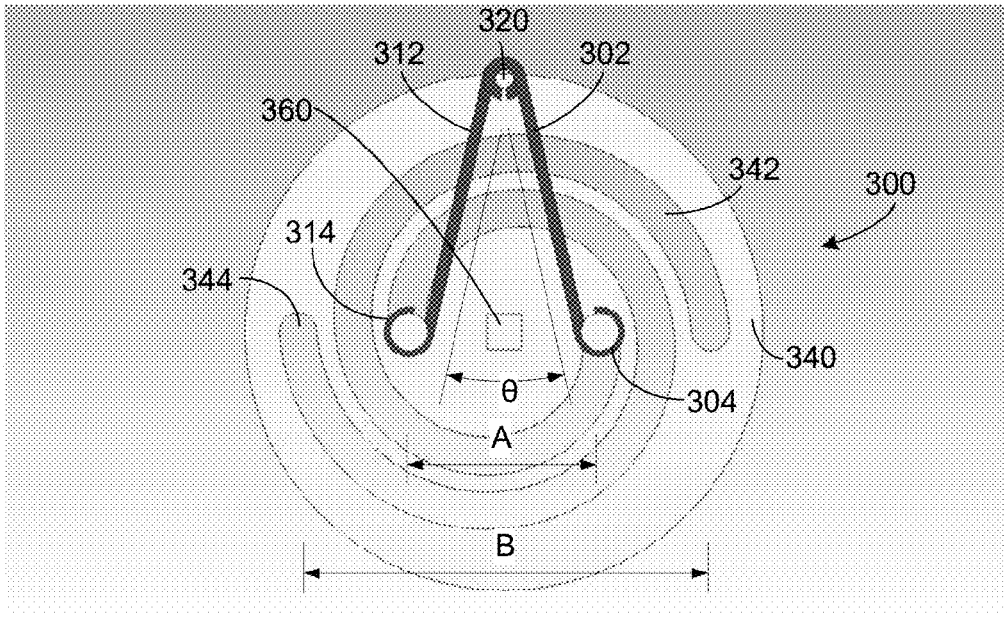
FIG. 4B provides a second side view of the multi-distributive lighting mount of FIG. 3 in accordance with one exemplary embodiment.

The exemplary first and second cams 340 and 350 each include the first and second spiraling channels, as best illustrated in FIGS. 4A and 4B. Based on the spiraling channels 352 and 354 of the second cam 350, as illustrated in FIG. 4A, the first and second pins 308 and 318 may be repositioned over a range of positions based on a rotation of the first cam 350. That is, based on rotation of the first and second cams 340 and 350, the spiraling channels push or pull the first and second pins 308 and 318 either together or apart. Particularly, for clockwise rotation of the first and second cams 340 and 350, the spiraling channels push the first and second pins 308 and 318 closer together. On the other hand, for counter-clockwise rotation of the first and second cams 340 and 350, the spiraling channels push the first and second pins 308 and 318 further apart. In alternative embodiments, the cams 340 and 350 and the spiraling channels 342, 344, 352, and 354 are formed to push or pull the first and second pins 308 and 318 together for counter-clockwise rotation of the first and second cams 340 and 350 and push or pull the first and second pins 308 and 318 apart for clockwise rotation of the first and second cams 340 and 350.

Although FIGS. 4A and 4B illustrate the exemplary multi-distributive lighting mount 300 in the same position, it should be appreciated that the mount 300 is positionable over a range of the angle θ between the first and second wings 302 and 312. That is, based on rotation of the first and second cams 340 and 350, the first and second pins 308 and 318 may be repositioned over a range of positions. For example, based on the spiraling channels of the first and second cams 340 and 350, the first and second pins 308 and 318 may be repositioned anywhere between from the first position A to the second position B, as provided in FIG. 4B. When repositioning the first and second pins 308 and 318 from the first position A to the second position B, the angle θ between the first and second wings 302 and 312 will vary, causing light generated by the lighting devices 350 and 352 to be distributed in various different directions.

Referring again to FIG. 3, the exemplary multi-distributive lighting mount 300 also includes an adjustment rod 360 extending through an approximate center of each of the first and second cams 340 and 350. In the exemplary embodiment of the multi-distributive lighting mount 300 illustrated in FIG. 3, each of the first and second cams 340 and 350 is adjoined to the adjustment rod 360 such that rotation of the adjustment rod 360 translates to rotation of the first and second cams 340 and 350 about a respective axis of symmetry of each of the cams 340 and 350. Thus, using the adjustment rod 350, the first and second pins 308 and 318 are slid within the spiraling channels of the cams 340 and 350 based on rotation of the cams 340 and 350. In turn, the first and second wings 302 and 312 are repositionable based on the rotation of the cams 340 and 350 using the adjustment rod 350. In embodiments of the multi-distributive lighting mount 300 using the first and second bases 330 and 332 and the channel 370, the first and second bases 330 and 332 may slide within the channel 370 when the first and second wings 302 and 312 are repositioned based on the rotation of the cams 340 and 350 using the adjustment rod 350. In various exemplary embodiments, the adjustment rod 360 is attached or adjoined to a means for rotating the adjustment rod 360, such as a wheel or knob.

In certain exemplary embodiments, the multi-distributive lighting mount 300 also includes multiple pairs of the first and second bases 330 and 332, and the channel 370 includes multiple channels 370. In certain exemplary embodiments, each pair of first and the second bases 330 and 332 is slidably positioned within a respective channel 370. Further, among the exemplary embodiments, the elements of the multi-distributive lighting mount 300, such as the first and second wings 302 and 312, the pins 308, 318, and 320, the bases 330 and 332, and the cams 340 and 350, among other elements, may be manufactured from various types of materials suitable for the application such as aluminum, other various metals or metallic alloys, and various types of plastic, for example. It is noted, however, that the multi-distributive lighting mount 300 may be formed from any material suitable for the application, without limitation.

Figure 5:
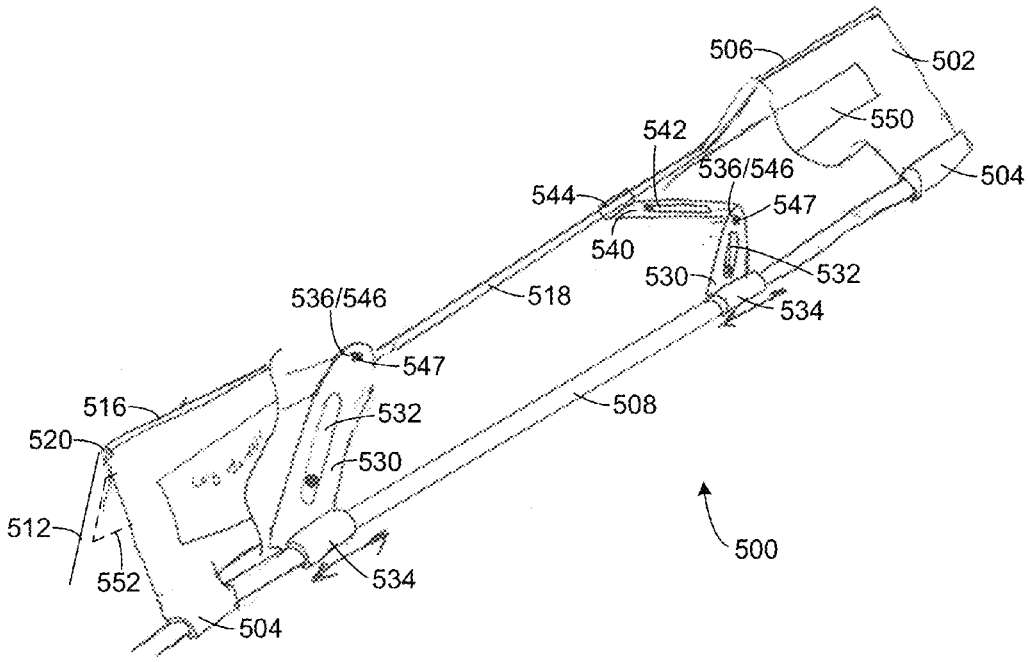
FIG. 5 provides a perspective cutaway view of another embodiment of a multi-distributive lighting mount in accordance with another alternative exemplary embodiment.
Figure 6:
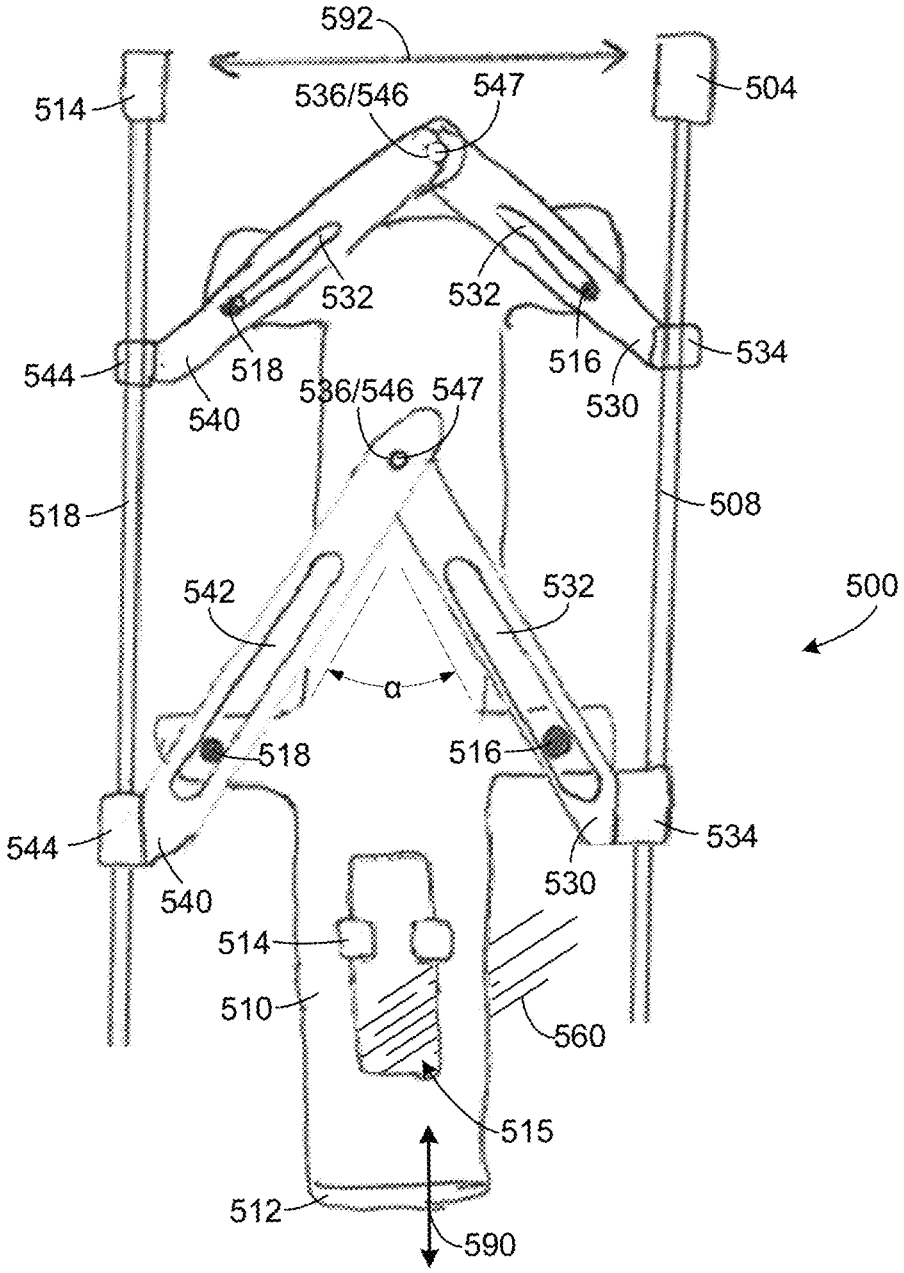
FIG. 6 provides another cutaway view of the multi-distributive lighting mount of FIG. 5 in accordance with one exemplary embodiment.

FIG. 5 provides a perspective cutaway view of an exemplary embodiment of an adjustable multi-distributive lighting mount 500. FIG. 6 provides another cutaway view of the multi-distributive lighting mount 500. Referring now to FIGS. 5 and 6, the exemplary multi-distributive lighting mount 500 includes a first light source mounting surface or wing 502 having a first barrel portion 504 adjoined at a first longitudinal side or edge and a second barrel portion 506 adjoined at a second longitudinal side or edge, and a second light source mounting surface or wing 112 having a first barrel portion 514 adjoined at a first longitudinal side or edge (see FIG. 6) and a second barrel portion 516 adjoined at a second longitudinal side or edge. The first wing 502 and the second wing 512 are adjoined by a means for rotationally coupling the first wing 502 and the second wing 512, such as a pin 520 extending through the second barrel portion 506 of the first wing 502 and through the second barrel portion 516 of the second wing 512. The pin 520 adjoins the first and second wings 502 and 512 at a pivot point such that the first and second wings 502 and 512 pivot about the pivot point, as described in further detail below.

In various embodiments, a lighting device 550 is mounted to the first wing 502, and a second lighting device 552 (hidden) is mounted to the second wing 512. In certain exemplary embodiments, the lighting devices 550 and 552 are mounted to the first and second wings 502 and 512 using any mechanical means suitable for the application, including screws, rivets, or magnets, or using adhesives, for example. Each of the lighting devices 550 and 552 may include, for example, multiple LEDs and other circuitry associated with the LEDS. For example, the exemplary lighting devices 550 and 552 include circuit traces, capacitors, and resistors, among other elements, to support the function of the LEDs. In alternative exemplary embodiments, the lighting devices 550 and 552 include light sources other than LEDs.

Referring again to FIGS. 5 and 6, the multi-distributive lighting mount 500 includes a scissor-action mechanism including at least one first scissor arm 530 having a barrel 534 at a first end of the arm 530, a pin eye 536 at a second end of the arm 530, and an elongated channel 532 between the first and second ends of the arm 530. The mechanism further includes a second scissor arm 540 that has a barrel 544 at a first end of the arm 540, a pin eye 546 at a second end of the arm 540, and a channel 542 between the first and second ends of the arm 540. A scissor pin 547 extends through the pin eye 536 of the first scissor arm 530 and through the pin eye 546 of the second scissor arm 540. The scissor pin 547 adjoins the first and second scissor arms 530 and 540 and creates a pivot point between the first and second scissor arms 530 and 540. Taken together, the first and second scissor arms 530 and 540 form a pair of scissor arms 530 and 540. When manipulated as further discussed below, the scissor-action mechanism moves the first and second wings 502 and 512 about the pivot point created by the pin 520 that adjoins the first and second wings 502 and 512. It is noted that, in certain embodiments, the scissor-action mechanism may multiple pairs of first and second scissor arms 530 and 540. For example, as illustrated in FIGS. 5 and 6, the scissor-action mechanism includes two pairs of first and second scissor arms 530 and 540. It is noted that, in certain aspects, the scissor-action mechanism comprises, at least in part, means for rotating the first and second wings 502 and 512.

In certain exemplary embodiments, a degree of freedom exists between the barrel 534 of the first scissor arm 530 and the scissor arm 530 itself. Similarly, a degree of freedom exists between the barrel 544 of the second scissor arm 540 and the scissor arm 540 itself. The exemplary barrels 534 and 544 are formed as hollow cylinders, as illustrated in FIG. 5. A first pin 508 of the multi-distributive lighting mount 500 extends through the first barrel portion 504 of the first wing 502 and through the barrel 534 of the first scissor arm 530, and a second pin 518 of the multi-distributive lighting mount 500 extends through the first barrel portion 514 of the second wing 512 and through the barrel 544 of the second scissor arm 540.

In certain exemplary embodiments, the barrel 534 of the first scissor arm 530 slides along the first pin 508, and the barrel 544 of the second scissor arm 540 slides along the second pin 518. In exemplary embodiments where the barrels 534 and 544 slide along the first and second pins 508 and 518, the hollow cylindrical centers of the barrels 534 and 544 may be sized at least slightly larger than the diameter of the first and second pins 508 and 518, to permit the barrels 534 and 544 to freely slide along at least a portion of a length of the first and second pins 508 and 518.

Referring to FIG. 6, the multi-distributive lighting mount 500 also includes an adjustment branch 510 with an adjustment tab 512, an attachment opening 515, and at least one pair of adjustment pegs 516 and 518. In certain exemplary embodiments, the pair of adjustment pegs 516 and 518 are formed to slidably fit within the channels 532 and 542 of the first and second scissor arms 530 and 540. In certain exemplary embodiments, the adjustment branch 510 includes a pair of adjustment pegs 516 and 518 for each pair of first and second scissor arms 530 and 540. One end of each of the adjustment pegs 516 and 518 is secured to the adjustment branch 510, and each of the adjustment pegs 516 and 518 extends through one of the channels 532 and 542 of the scissor arms 530 and 540. In certain exemplary embodiments, the pair of adjustment pegs 516 and 518 may be secured such that, although the adjustment pegs 516 and 518 are free to slide within the channels 532 and 542, the adjustment pegs 516 and 518 are unable to be removed from the channels 532 and 542. For example, in certain exemplary embodiments, each of the adjustment pegs 516 and 518 includes a cap or top that extends beyond the width of the channels 532 and 542, keeping the adjustment pegs 516 and 518 from being removed from the channels 532 and 542 after assembly of the multi-distributive lighting mount 500.

Thus, in certain embodiments, each of the first and second scissor arms 530 and 540 is secured to the adjustment branch 510, while still being permitted at least a certain range of motion. In turn, the first and second wings 502 and 512 are also secured to the adjustment branch 510 based on the structural assembly among the first and second wings 502 and 512, the first and second pins 508 and 518, and the barrels 534 and 544 at the ends of the first and second scissor arms 530 and 540. It is noted that, although the first and second wings 502 and 512 are also secured to the adjustment branch 510, the first and second wings 502 and 512 are still permitted at least a certain range of motion. Particularly, although being secured in part to the adjustment branch 510, the first and second wings 502 and 512 are still able to pivot about the pivot point created by the pin 120, allowing a variable distribution of light provided by the light sources on the light devices 550 and 552.

In certain exemplary embodiments, attachment tabs 514 slidably grasp edges of the attachment opening 515, holding the adjustment branch 510 to the substrate 560 while permitting the adjustment branch 510 at least a range of motion in a first direction 590. That is, in certain exemplary embodiments, the attachment tabs 514 are secured to the substrate 560 and hold the adjustment branch 510 to the substrate 560. As illustrated in FIG. 6, the attachment opening 515 is formed in a rectangular shape, and the attachment tabs 514 grasp opposing edges of the attachment opening 515 while permitting the adjustment branch 510 at least a range of motion in the first direction 590. The sizing of the attachment opening 515 may vary based on the embodiment. In certain exemplary embodiments, the substrate 560 is any generally flat surface upon which the multi-distributive lighting mount 500 may be mounted.

In operation, the exemplary multi-distributive lighting mount 500 is adjusted using the adjustment tab 512 of the adjustment branch 510, by sliding the adjustment branch 510 along the direction 590. In turn, the adjustment pegs 516 and 518 apply forces to the scissor arms 530 and 540 via the edges of the channels 532 and 542, causing the scissor arms 530 and 540 to pivot about the pivot point created by the pin 547. As the pivot point created by the pin 547 varies, the angle $\alpha$ between the first and second scissor arms 530 and 540 varies, and the barrels 534 and 544 of the scissor arms 530 and 540 apply forces to the first and second pins 508 and 518 to push or pull the first and second pins 508 and 518 in a second direction 592. When pushed or pulled by the barrels 534 and 544 of the scissor arms 530 and 540, the first and second pins 508 and 518 move in the second direction 592 which is perpendicular to the first direction 590. The movement of the first and second pins 508 and 518 in the second direction 592 causes the first and second wings 502 and 512 to pivot about the pivot created by the pin 520. When the first and second wings 502 and 512 pivot about the pivot created by the pin 520, the distribution of light generated by light sources on the lighting devices 550 and 552 varies. It is noted that, based on the sizing of the attachment opening 515, the range of motion of the scissor-action mechanism and, thus, the first and second wings 502 and 512 is impacted. Particularly, the length of the opposing sides of attachment opening 515 grasped by the attachment tabs 514 impacts the range of motion of the scissor-action mechanism. Similarly, the range of motion of the scissor-action mechanism may be impacted by the size or length of the channels 542 and 532. As such, in various exemplary embodiments, the size or length of the channels 542 and 532 varies depending upon the desired operation of the multi-distributive lighting mount 500.

In alternative embodiments, the adjustment branch 510 attaches to the scissor arms 530 and 540 at the pin eyes 536 and 546 of the scissor arms 530 and 540 rather than at the channels 532 and 542, although the operation of the scissor-action mechanism would be similar. In other alternative embodiments, the barrels 534 and 544 of the scissor arms 530 and 540 are fixed in position (i.e., do not slide) along the pins 508 and 518.

As with the multi-distributive lighting mounts 100 and 300, the multi-distributive lighting mount 500 offers the ability to reposition the first and second wings 502 and 512 over a range of positions based on the pivot point created by the pin 520. As such, light generated by the lighting devices 550 and 552 may be redistributed over a range of distribution, as set by a user based movement of the adjustment branch 510. The multi-distributive lighting mount 500 provides advantages as compared to conventional light fixtures which fail to permit light sources to be repositioned and fail to permit light provided by the light sources to be redistributed. Particularly for a light fixture incorporating LED light sources, the range of light distribution provided by the multi-distributive lighting mount 500 offers additional flexibility in lighting options.

Although embodiments of the present invention have been described herein in detail, the descriptions are by way of example. The features of the invention described herein are representative and, in alternative embodiments, certain features and elements may be added or omitted. Additionally, modifications to aspects of the embodiments described herein may be made by those skilled in the art without departing from the spirit and scope of the present invention defined in the following claims, the scope of which are to be accorded the broadest interpretation so as to encompass modifications and equivalent structures.

What is claimed is:

1. An adjustable lighting mount, comprising:

a first mounting surface comprising a first longitudinal side, an opposing second longitudinal side, a first barrel portion extending out from the first longitudinal side of the first mounting surface, and a second barrel portion extending out from the second longitudinal side of the first mounting surface;

a first light source coupled to the first mounting surface;

a second mounting surface rotatably coupled to the first mounting surface along the second longitudinal side of the first mounting surface, the second mounting surface comprising a first barrel portion extending out from a first longitudinal side of the second mounting surface, and a second barrel portion extending out from a second longitudinal side of the second mounting surface;

a second light source coupled to the second mounting surface; and a means for rotating the first mounting surface with respect to the second mounting surface coupled to the second longitudinal side of the first mounting surface, the means for rotating comprising a first base slidably positioned over a substrate, and a first pin extending through and coupling the first base to the first barrel portion of the first mounting surface.

2. The adjustable lighting mount of claim 1, wherein the means for rotating the first mounting surface with respect to the second mounting surface further comprises:

a second base slidably positioned over the substrate; and a second pin extending through and coupling the second base to the first barrel portion of the second mounting surface.

3. The adjustable lighting mount of claim 2, wherein the first pin and the second pin extend longitudinally in a first direction, and the lighting mount further comprises a positioning rod extending though the first and second bases in a second direction perpendicular to the first direction.

4. The adjustable lighting mount of claim 3, further comprising:

a first friction clamp that adjustably maintains a position of the first base with respect to the substrate; and a second friction clamp that adjustably maintains a position of the second base with respect to the substrate, wherein the positioning rod extends through the first and second friction clamps, and the first and second friction clamps releasably clamp to and slide along the positioning rod to adjust a pivot point and an angle between the first and second mounting surfaces.

5. The adjustable lighting mount of claim 4, wherein the pivot point pivots over a range of angles based on respective positions of the first and second bases.

6. The adjustable lighting mount of claim 1, wherein the substrate comprises a channel and the first and second bases are slidably disposed within the channel.

7. The adjustable lighting mount of claim 1, wherein each of the first and second light sources comprises longitudinally extending Light Emitting Diode (LED) light modules.

8. An adjustable lighting mount, comprising:

a first mounting surface including a first longitudinal side, an opposing second longitudinal side, a first barrel portion extending out from the first longitudinal side of the first mounting surface, and a second barrel portion extending out from the second longitudinal side of the first mounting surface;

a second mounting surface rotatably coupled to the first mounting surface along the second longitudinal side of the first mounting surface, the second mounting surface comprising a first barrel portion extending out from a first longitudinal side of the second mounting surface and a second barrel portion extending out from a second longitudinal side of the second mounting surface;

a light source coupled to one of the first and second mounting surfaces; and a means for rotating the first mounting surface with respect to the second mounting surface coupled to the second longitudinal side of the first mounting surface, wherein the means for rotating comprises:

a first cam having a first spiraling channel and a second spiraling channel;

a second cam having a first spiraling channel and a second spiraling channel;

a first pin extending through the first spiraling channel of the first cam, through the first barrel portion of the first mounting surface, and through the first spiraling channel of the second cam; and a second pin extending through the second spiraling channel of the first cam, through the first barrel portion of the second mounting surface, and through the second channel of the second cam.

9. The adjustable lighting mount of claim 8, further comprising:

an adjustment rod extending through an approximate center of the first and second cams, each of the first and second cams being adjoined to the adjustment rod such that rotation of the adjustment rod translates to rotation of the first and second cams about a respective axis of symmetry of each of the cams.

10. An adjustable lighting mount, comprising:

a first mounting surface including a first longitudinal side and an opposing second longitudinal side;

a second mounting surface rotatably coupled to the first mounting surface along the second longitudinal side of the first mounting surface;

a light source coupled to one of the first and second mounting surfaces; and a means for rotating the first mounting surface with respect to the second mounting surface coupled to the second longitudinal side of the first mounting surface, wherein the means for rotating comprises, a first scissor arm comprising a barrel at a first end of the first scissor arm, a pin eye at a second end of the first scissor arm, and a channel between the first and second ends of the first scissor arm, and a second scissor arm comprising a barrel at a first end of the second scissor arm, a pin eye at a second end of the second scissor arm, and a channel between the first and second ends of the second scissor arm.

11. The adjustable lighting mount of claim 10, wherein the means for rotating further comprises:

an adjustment branch including an adjustment tab, an attachment opening, and a pair of adjustment pegs, wherein the pair of adjustment pegs are slideably positioned within the channels of the first and second scissor arms.

12. The adjustable lighting mount of claim 10, wherein the first light source comprises longitudinally extending Light Emitting Diode (LED) light modules.

13. An adjustable lighting mount, comprising:

a first mounting surface comprising a first longitudinal side, an opposing second longitudinal side, and a second barrel portion extending out from the second longitudinal side of the first mounting surface;

a first light source coupled to the first mounting surface;

a second mounting surface rotatably coupled to the first mounting surface along the second longitudinal side of the first mounting surface, the second mounting surface comprising a second barrel portion extending out from a second longitudinal side of the second mounting surface;

a second light source coupled to the second mounting surface;

a means for rotating the first mounting surface with respect to the second mounting surface coupled to the second longitudinal side of the first mounting surface; and a pin coupling the second barrel portion of the first mounting surface to the second barrel portion of the second mounting surface, to rotatably couple the first mounting surface to the second mounting surface.

* * * * *